United States Patent [19]

Bauer et al.

[11] Patent Number: 4,491,277

[45] Date of Patent: Jan. 1, 1985

[54] METHOD AND APPARATUS FOR RECLAIMING FOUNDRY SAND

[75] Inventors: Hans Bauer, Neunkirchen-Seelscheid; Heinz-Withold Schmitz, Essen, both of Fed. Rep. of Germany

[73] Assignee: Klöckner-Humboldt-Deutz AG, Fed. Rep. of Germany

[21] Appl. No.: 554,381

[22] Filed: Nov. 25, 1983

Related U.S. Application Data

[63] Continuation of Ser. No. 343,402, Jan. 28, 1982, abandoned.

[30] Foreign Application Priority Data

Jan. 30, 1981 [DE] Fed. Rep. of Germany ..... 3103030

[51] Int. Cl.[3] ..... B02C 19/12

[52] U.S. Cl. ..... 241/5; 241/14; 241/23; 241/24; 241/DIG. 10

[58] Field of Search ..... 241/5, 39, 40, 14, 17, 241/18, 23, DIG. 10, 65, 81, 24; 164/5, 4, 2

[56] References Cited

U.S. PATENT DOCUMENTS

| | | | |
|---|---|---|---|
| 2,515,194 | 7/1950 | Christensen | 241/23 X |
| 2,991,187 | 7/1961 | Sellers et al. | 241/5 X |
| 3,979,073 | 9/1976 | Leliaert | 241/DIG. 10 |
| 4,354,641 | 10/1982 | Smith | 241/40 |

*Primary Examiner*—Mark Rosenbaum

*Attorney, Agent, or Firm*—Hill, Van Santen, Steadman & Simpson

[57] ABSTRACT

A method and apparatus for reclaiming foundry sand from contaminated foundry sand wherein ferromagnetic contaminants are first removed in a magnetic separating zone, and the remaining contaminated sand is thermally treated at a temperature sufficiently high to cause embrittlement of clay constituents among the remaining contaminants, and finally the thermally treated material is comminuted, preferably in a counterflow impact jet mill to recover a reclaimed foundry sand substantially free from contaminants.

3 Claims, 1 Drawing Figure

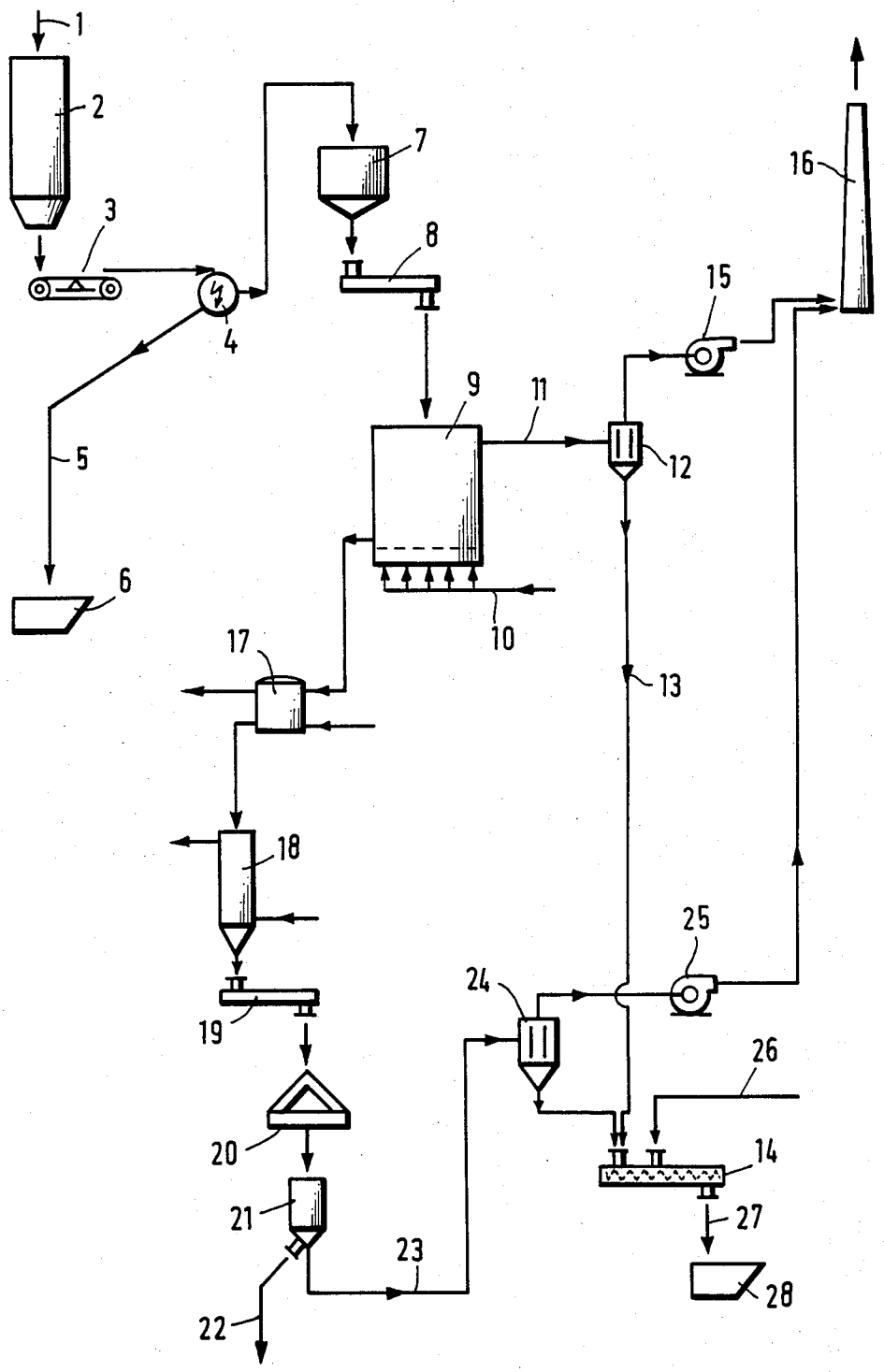
1
2
3
4
5
6
7
8
9
10
11
12
13
14
15
16
17
18
19
20
21
22
23
24
25
26
27
28

METHOD AND APPARATUS FOR RECLAIMING FOUNDRY SAND

This application is a continuation of application Ser. No. 343,402, filed Jan. 28, 1982, now abandoned.

BACKGROUND OF THE INVENTION

1. Field of the Invention

This invention is in the field of reclaiming foundry sand for reuse after contamination by metals, binders, and the like. The invention is concerned with treating the contaminated foundry sand sequentially in a magnetic separating zone, a thermal treatment zone, and a comminution zone from which the reclaimed sand particles are recovered.

2. Description of the Prior Art

Used foundry sand represents a mixture of more or less large agglomerates consisting of silica sand grains, dust, binding agents, and metallic particles which may remain from the casting process. The binding agents usually exist in loose form in admixture with the sand, but they may also be partially adhered to the silica sand grains. Binding materials such as bentonite clay, synthetic resins based on phenols or resols, water glass, and the like, are frequently present as binding agents.

The substantial costs involved in the preparation of sand for foundry use as well as the transporting and disposition of used sand, particularly in view of the requirements of keeping ground water clean, make a reclaiming of used foundry sand economically desirable. The reuse of the old sand, however, must be accompanied by processing which is directed toward the removal of contaminants from the sand which would interfere with the use of the sand in a mold making process.

For example, iron particles or other ferromagnetic particles tend to sinter together during the casting process with the silica sand grains and must therefore be removed completely along with fine grain components and binding agents. In addition, a cleaning device which is used to break up the sand agglomerates from the binding agent must be cleanly removed from the silica grains without, at the same time, causing excessive fracturing of the grains which would provide an undesired amount of fine grains.

The grinding of silica sand generally involves a significant wear on the grinding tools, particularly impact pulverizers and vibration grinding mills so that the economic feasibility of such recovery methods is impaired. Selection of a suitable cleaning process is also rendered difficult by the fact that the wear during the grinding process also produces unavoidable iron fines which are harmful in the casting process, and which have to be removed by a further step. It would be possible to use vibration grinding mills which utilize iron-free linings as well as appropriate grinding bodies, but this involves relatively high capital costs which limit the economic feasibility of the reclaiming process.

SUMMARY OF THE INVENTION

The present invention provides a method for recovering foundry sand from contaminated foundry sand in an economical manner while avoiding the difficulties mentioned previously. The reclaiming of the foundry sand is achieved by passing the same in series through at least one magnetic separating zone, one thermal treatment zone, and one cleaning zone. The magnetic separating zone serves to separate any ferromagnetic components from the contaminated foundry sand, and the thermal treatment zone serves to provide for the combustion of carbon, and the chemical conversion of binding agent components. For example, in the use of bentonite clay, this material is converted by means of the thermal treatment into mullite by dehydration and the loss of structural water. The mullite is considerably more brittle and lends itself to a nearly complete stripping from the surface of the silica sand so that the product of the cleaning zone is a mixture of clean silica sand grains free of binding agent incrustations as well as binding agent residues from which the silica sand grains can be recovered through known methods.

In a preferred embodiment of the invention, the contaminated foundary sand is cooled after passing through the thermal treatment zone and before introduction into the cleaning zone. The cooling serves the purpose of thermally relieving the succeeding cleaning process and the heat retained by the sand from the thermal treatment zone can be partially regained and reused in any desired manner.

In a particularly preferred embodiment of the invention, the cleaning of the used foundry sand is carried out in the cleaning zone by means of a counterflow jet impact process utilizing air velocities preferably in the range from 30 m/sec to 50 m/sec. This method of cleaning results in very little wear on the cleaning aggregate, so that by selecting appropriate air velocities, the cleaning can be carried out in such a manner that the silica sand grains are cleansed of adhering binding agent residues but are not themselves fractured.

BRIEF DESCRIPTION OF THE DRAWINGS

The single FIGURE in the drawing illustrates schematically a reclaiming process for foundry sand utilizing the improvements of the present invention.

DESCRIPTION OF THE PREFERRED EMBODIMENTS

Referring to the drawing, used foundry sand is delivered as indicated by the arrow 1 into a multi-chamber storage bin 2 and is transported therefrom by means of a weighing type conveyor 3 into a magnetic separator 4. In the illustrated embodiment of the invention, the magnetic separator 4 takes the form of a weak field drum magnetic separator. The magnetizable portions of the used sand are separated out into a container 6 through a discharge line 5.

The non-magnetic portions of the sand are subsequently delivered from the magnetic separator 4 through a surge bin 7 to a furnace by means of a tube conveyor 8 for the thermal treatment of the remaining foundry sand.

The furnace 9 is preferably a fluidized bed furnace consisting of a cylindrical, vertically disposed lined combustion chamber into the lower portion of which hot gases are introduced as illustrated by the arrows 10. The hot gases are received from a hot gas source (not illustrated) and are introduced into the fluidized bed furnace 9 in such an amount and at such a temperature that temperatures of at least 870° C. exist in the combustion zone of the furnace 9. The conditions are such that a fluidized bed consisting of an incandescent bed of sand is formed. A very intensive admixture with hot gases occurs in this fluidized bed in which the used foundry sand remains for a period up to 45 minutes. During the thermal treatment, the carbon present burns off and the quartz present is transformed into tridymite which is a vitreous form of pure silica. This transformation occurs with about a 16% increase in volume at a temperature of 870° C.

The thermal treatment in the fluidized bed furnace 9 also serves to separate the combustible components of the mixture, including carbonaceous materials. Any bentonite component is dehydrated with the loss of structural water to form a phase of mullite which is considerably more brittle than the original bentonite. At the same time, a fine grain component is separated out and leaves the fluidized bed furnace 9 as shown by the arrow 11 together with the hot exhaust gases. This fine grain component is separated out in a dust filter 12 and as shown by the arrow 13 is delivered to a mixer 14. An exhaust gas blower 15 delivers the dust-free exhaust gases to a chimney 16.

The thermally treated sand is directed from the fluidized bed furnace 9 to a cooling stage consisting of a pair of coolers 17 and 18 connected in series. After the last cooling stage 18, a tube conveyor 19 delivers the cooled sand into an air jet mill, preferably a counterflow impact jet mill 20. At the output of the cooler 17, the sand has a temperature of approximately 250° C. while when leaving the cooler 18, it has a temperature of approximately 25° to 30° C.

The grinding zone of the impact mill 20 consists of two injectors disposed opposite one another and operated with compressed air jets which provide the material to be cleaned at velocities of approximately 30 m/sec to 50 m/sec. The compressed air jets emerging from the injectors and carrying the solids collide with one another frontally, and the sand particles are cleaned solely by the collision of the particles against one another. The counterflow impact mill 20 thus serves the purpose of stripping solid crusts consisting of residues of binding agent from the surfaces of the silica sand without the silica sand grains themselves being comminuted. The discharge product of the impact mill 20 is thus a mixture consisting of silica sand grains which represent the coarse grain component and the fractured crust particles which are the fine-grained component. These two components are separated in a sifter 21. The coarse grained fraction is recovered through a line 22 and recycled to the foundry. By changing the operating variables in the sifter operation, different sand qualities and different grain categories can be produced in a simple manner.

The fine-grained fraction of the sifter 21 is delivered by means of a line 23 into a dust filter 24 where the remaining exhaust gas is discharged by means of an exhaust gas blower 25 into the chimney 16.

The fine-grained fraction separated out in the dust filter 24 as well as the fine-grained fraction from the dust filter 12 are subsequently combined in a mixer 14 by the addition of water or a foundry waste slurry through a line 26 into a storable, non-dust-producing waste product which is delivered by means of a line 27 into a container 28.

The three fractions produced according to the method of the present invention consist of magnetizable components collected in a container 6, fine-grained dust components constituting a second waste product collected in a container 28 and the reusable foundry sand delivered through the discharge line 22.

It should be evident that various modifications can be made to the described embodiments without departing from the scope of the present invention.

We claim as our invention:

1. A method for reclaiming foundry sand from foundry sand contaminated with a binder which comprises:

separating ferromagnetic contaminants from the contaminated sand in a magnetic separating zone, thermally treating the remaining contaminated sand in a fluidized bed at a temperature of at least 870° C. for up to 45 minutes to cause burning off of carbon and embrittlement of binder constituents among the remaining contaminants, cooling the sand after such thermal treatment, cleaning the thus treated sand in a counterflow impact jet mill operating at air velocities of from 30 to 50 m/sec to strip solid binder crusts from the surfaces of the sand grains essentially by collisions of said particles with each other, and sifting the thus cleaned sand to separate relatively coarse, non-comminuuted sand grains from finer grained particles of fractured binder crusts.

2. A method according to claim 1 in which:

said thermal treating is carried out at a temperature sufficient to transform bentonite constituents into mullite.

3. A method according to claim 1 in which:

said thermal treating is carried out at a temperature sufficient to transform quartz impurities present into tridymite.

* * * * *